US006390233B1

(12) United States Patent
Barthalow

(10) Patent No.: US 6,390,233 B1
(45) Date of Patent: May 21, 2002

(54) METHOD FOR A LIFTING APPARATUS WITH FLOATING LIFT CYLINDER ATTACHMENT

(75) Inventor: Henry David Barthalow, Greencastle, PA (US)

(73) Assignee: Grove U.S. LLC, Shady Grove, PA (US)

( * ) Notice: Subject to any disclaimer, the term of this patent is extended or adjusted under 35 U.S.C. 154(b) by 0 days.

(21) Appl. No.: 09/661,293

(22) Filed: Sep. 13, 2000

Related U.S. Application Data

(62) Division of application No. 09/184,020, filed on Nov. 2, 1998.

(51) Int. Cl.[7] ..... E04G 1/00
(52) U.S. Cl. ..... 182/2.9; 182/69.6
(58) Field of Search ..... 182/2.9, 2.11, 182/2.3, 69.6

(56) References Cited

U.S. PATENT DOCUMENTS

| | | | | |
|---|---|---|---|---|
| 4,602,462 A | | 7/1986 | Anderson | |
| 4,775,029 A | | 10/1988 | MacDonald | |
| 4,944,364 A | * | 7/1990 | Blasko | |
| 5,465,808 A | * | 11/1995 | Musgrove | |
| 5,501,346 A | * | 3/1996 | Wimmer | |
| 5,518,129 A | | 5/1996 | Sieberer | |

FOREIGN PATENT DOCUMENTS

| | | | | |
|---|---|---|---|---|
| DE | 2058592 | * | 5/1972 | ..... 182/2.9 |
| FR | 2331511 | | 11/1975 | |
| FR | 2600634 | | 6/1986 | |
| SE | 315089 | | 9/1969 | |

* cited by examiner

*Primary Examiner*—Alvin Chin-Shue
(74) *Attorney, Agent, or Firm*—Birch, Stewart, Kolasch & Birch, LLP

(57) ABSTRACT

A method of operating a lifting apparatus for moving an arm structure is disclosed. The lifting apparatus includes a first arm structure and a second arm structure pivotally connected to the first arm structure. The apparatus further includes a moving device and a displacing link for displacing the moving device relative to at least the first or second arm structures. The displacing link provides the moving device with a mechanical advantage whereby work required to move the second arm structure is substantially reduced while lifting capacity of the second arm structure and the moving device is substantially increased, and the range of motion of the second arm structure relative to the first arm structure is also increased.

20 Claims, 5 Drawing Sheets

METHOD FOR A LIFTING APPARATUS WITH FLOATING LIFT CYLINDER ATTACHMENT

This application is a division of Ser. No. 09/184,020 filed Nov. 2, 1998.

BACKGROUND OF THE INVENTION

1. Field of the Invention

The present invention relates to a lift method and apparatus for moving an arm structure such as a boom of a crane.

2. Description of the Background Art

Various devices for moving an arm structure such as a lifting arm currently exist. These devices typically employ connecting plates joining relatively movable first and second arm structures. Known arrangements of this type require an excessive amount of force from a moving device that is attached to one of the arm structures and the connecting plate. Furthermore, the conventional art provides a limited range of movement of the second arm structure relative to the first arm.

For example, the conventional art of FIG. 9 shows a first arm structure 10 and a second arm structure 12 fastened together by connecting plate 14. Arm 12 pivots about pin 18, mounted in plate 14. A hydraulic piston and cylinder arrangement 16 is connected to the second arm structure 12 and to connecting plate 14. As shown with the dashed lines in FIG. 9, when the second arm structure 12 approaches a fully extended position, the movement of the second arm structure 12 with respect to the first arm structure 10 is limited by the orientation of the hydraulic piston and cylinder arrangement 16 relative to arm structure 12.

In the fully extended position, the hydraulic piston and cylinder arrangement 16 contacts the pin connection 18 that fastens the second arm structure 12 to the connecting plate 14. This limits the range of motion of arm 12.

As illustrated in FIG. 9, the conventional arm structure arrangement is highly inefficient when the second arm structure 12 approaches a fully extended position. This inefficiency can be explained with reference to the angle θ between longitudinal axis B1 of moving device 16 and longitudinal axis A1 of arm structure 12. This angle θ affects the respective forces generated by the second arm structure 12 (denoted as $F_{12}$) and the hydraulic piston and cylinder arrangement 16 (denoted as $F_{16}$).

As the arm 12 approaches a fully extended position, a longitudinal axis B1 of the piston and cylinder 16 is nearly parallel to a longitudinal axis A1 of arm 12, where angle θ substantially approaches 0°. The extending force $F_{16}$ generated by the hydraulic piston and cylinder arrangement 16 is nearly perpendicular to force $F_{12}$, which is the component of force tending to rotate arm 12 counterclockwise due to the weight of arm 12 plus any loads carried by arm 12. Force $F_{16}$, which has component forces $F_{16a}$ and $F_{16b}$, therefore, cannot efficiently counteract force $F_{12}$.

Accordingly, a need in the art exists for a lift method and apparatus for moving an arm structure that substantially increases a range of motion of a second arm structure relative to a first arm structure and which also provides a moving device with a mechanical advantage whereby work required to move the second arm structure relative to the first arm structure is substantially reduced while lifting capacity of the moving device is substantially increased.

SUMMARY OF THE INVENTION

Accordingly, it is a primary object of the present invention to provide a lift method and apparatus for moving an arm structure which substantially increases a range of motion of a second arm structure relative to a first arm structure while providing a mechanical advantage for the moving device whereby work required to move the second arm structure relative to the first arm structure is substantially reduced while lifting capacity of the moving device is substantially increased.

It is a further object of the present invention to provide a lift method and apparatus for moving an arm structure which substantially lowers the overall height and center of gravity of a first arm structure, a second arm structure, and a connecting plate system when the first arm structure and second arm structure are in a stowed position.

A further object of the present invention is to provide a lift method and apparatus for moving an arm structure which includes means for displacing a moving device relative to a said first arm whereby the moving device is provided with a mechanical advantage with respect to forces which oppose the moving device that are created by the arm structure.

A further object of the present invention is to provide a lift method and apparatus for moving an arm structure which substantially increases a range of motion of the second arm structure relative to the first arm structure when at least the second arm structure substantially approaches an extended position.

An additional object of the present invention is to provide a lift method and apparatus for moving an arm structure wherein the apparatus and method can be employed in a crane environment such that a first arm structure is a riser while the second arm structure is a boom connected to the riser by a riser connecting plate. A specific object is to provide a moving device in the form of a hydraulic piston and cylinder arrangement which is provided with a substantially increased lifting capacity due to a displacing device which movably connects the hydraulic piston and cylinder arrangement to the connecting plate.

Another object of the present invention is to provide a lift method and apparatus for moving an arm structure that substantially maximizes the lift of the moving device as the moving device moves through its operating range.

A further object of the present invention is to provide a lift method and apparatus for moving an arm structure that allows for increased lifting capacity, weight savings, manufacturing cost savings, and a reduction in work performed by the moving device or a reduction in hydraulic pressure. Another object of the present invention is to make more compact the mechanical elements which connect the moving device to the arm structure, while substantially achieving a shorter load radius for a given boom length or second arm structure length.

These and other objects of the present invention are fulfilled by providing a lift apparatus for moving an arm structure comprising: a first arm structure; a second arm structure having first longitudinal axis, said second arm structure being rotatable relative to the first arm structure; a moving device for applying a force along a second longitudinal axis; and at least one means for displacing the moving device relative to the first arm and the second arm during at least a portion of the range of motion of the second arm for increasing a range of motion of the second arm structure relative to the first arm structure and for providing said moving device with an increased mechanical advantage for moving the second arm structure relative to the first arm structure.

In addition, these and other objects of the present invention are also accomplished by providing a method of operating an apparatus comprising a first arm structure, a second arm structure pivotally attached to the first arm structure, and a moving device for creating relative pivotal movement between the first and second arm structures, the method comprising: activating the moving device to move the first and second arms relative to each other, and during at least a portion of the range of relative movement of the first and second arms, displacing the moving device with respect to at least one of the first arm or the second arm so as to improve the mechanical advantage of the moving device in generating the relative movement.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
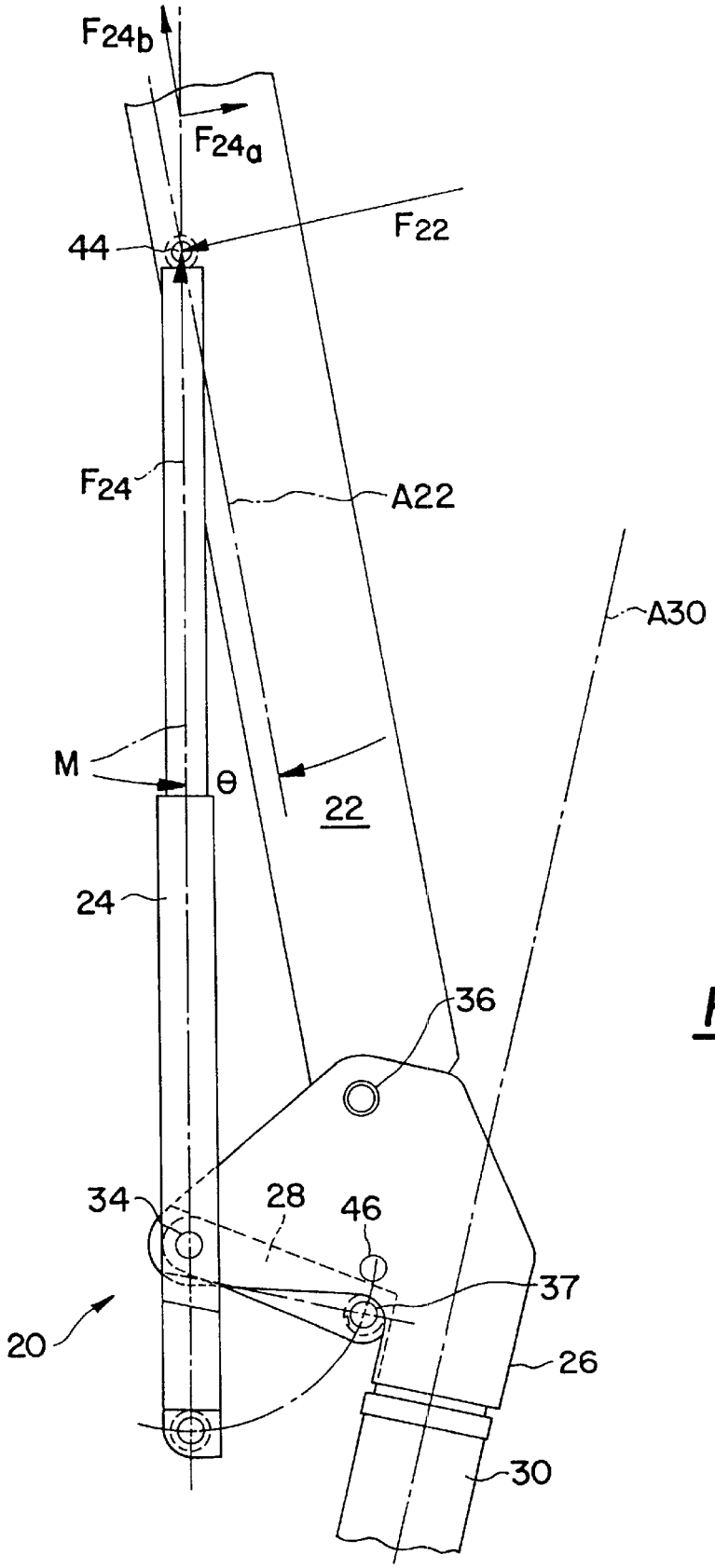
FIG. 1 is a side view of the lift apparatus of the present invention which includes a sketch of a free-body diagram of the connection between the moving device and the second arm structure of the present invention.
Figure 2:
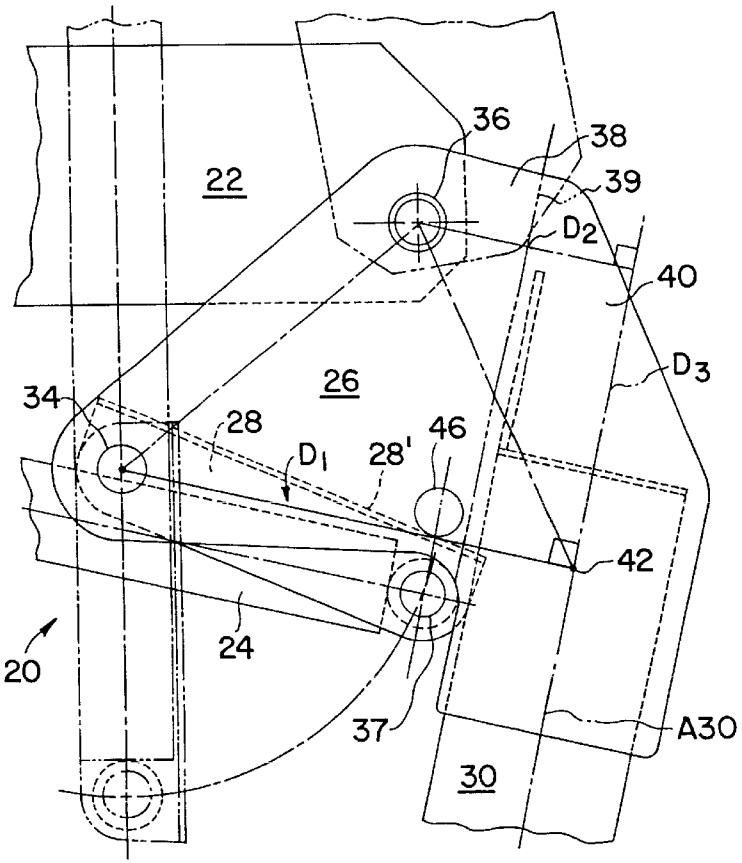
FIG. 2 is a close up side view of the lift apparatus of the present invention.

Referring in detail to the drawings and with particular reference to FIG. 1 and FIG. 2, a lift apparatus 20 for moving an arm structure 22 is shown. The lift apparatus 20 includes a moving device 24 which attaches to the arm structure 22. The moving device 24 is also attached to a connecting plate 26 via means 28 for displacing the moving device 24. The connecting plate 26 is attached to another arm structure 30. The arm structures 22 and 30 may typically be part of a crane or similar apparatus where arm structure 22 is a boom while arm structure 30 is a riser and the connecting plate 26 is a riser plate.

It is contemplated that the lift apparatus 20 will be used in a hydraulic crane which employs a hydraulic piston and cylinder arrangement as the moving device 24. The displacement device or means 28 preferably includes a link which connects the moving device 24 to the connecting plate 26. The displacing means 28 is not limited to a single link and may include other structures which facilitate displacement of the moving device 24.

In a preferred embodiment, the displacing means 28 is fastened to the connecting plate 26 and the moving device 24 by pin/cylinder arrangements. The connection between the displacing means 28 and connecting plate 26 is referred to as a first pivot point 34. First pivot point 34 may be an aperture in the connecting plate 26. This aperture permits the insertion of the fastening devices which connect the displacing means 28 to the connecting plate 26. An important feature of the pivot point 34 is to permit rotation of a displacement means 28 about pivot point 34 as well as to provide, during at least a portion of the range of movement of arm structure 22 relative to arm 30, a predetermined translational movement between pivot point 34 and a longitudinal axis A30 of arm structure 30.

Similar to first pivot point 34 is second pivot point 36. The structure of second pivot point 36 is similar to the pivot point 34 and preferably includes pin/cylinder arrangements to pivotally connect the arm structure 22 to the connecting plate 26.

Also shown in FIG. 1 is a stopping device 46 which limits counter-clockwise movement of the displacement means 28 about pivot point 34. The stopping device 46 comprises a pin or other abutment structure. Stopping device 46 is positioned so as to prevent rotation of the displacing means 28 in the counter-clockwise direction, as illustrated, when arm structure 22 is moved toward the stowed position.

Figure 9:
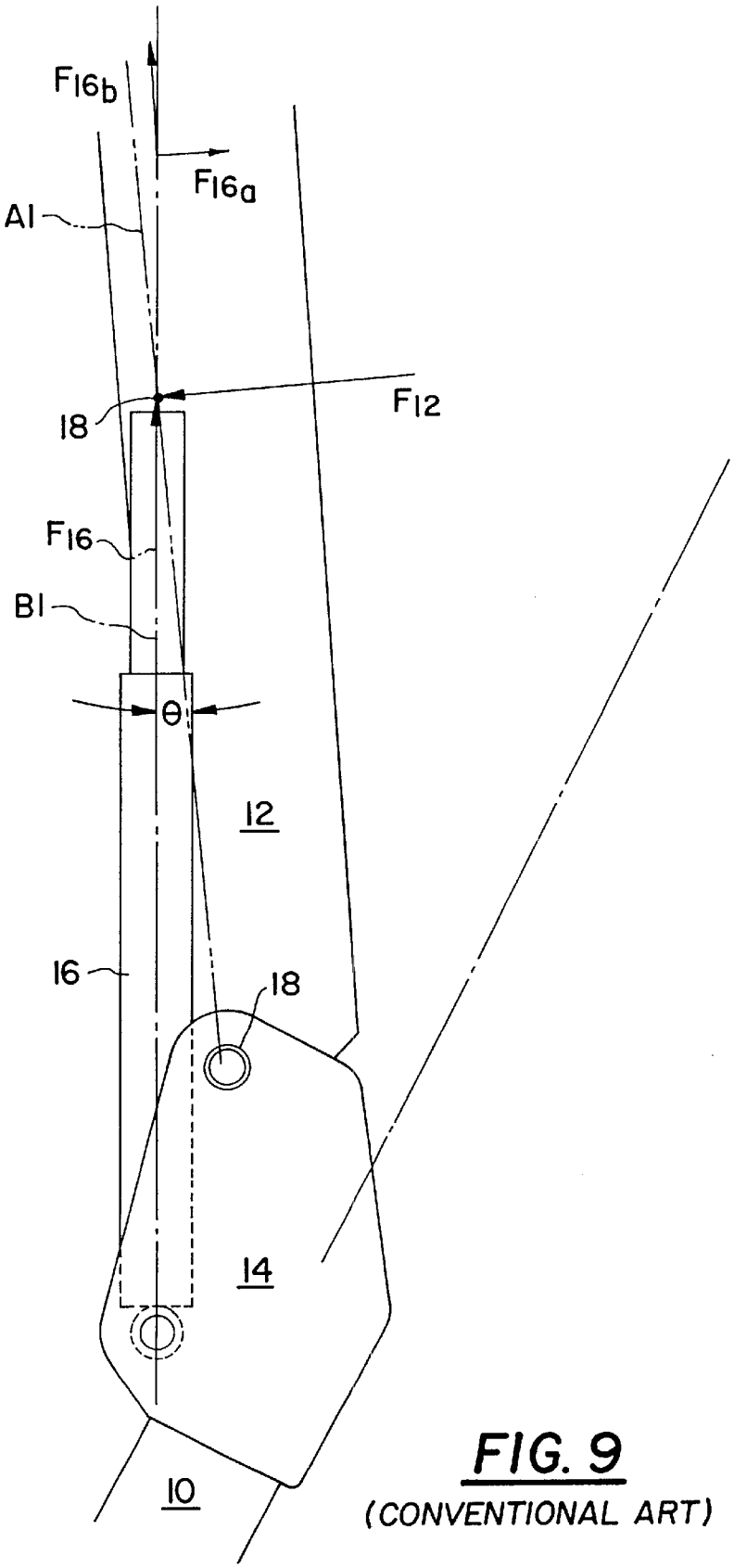
FIG. 9 (CONVENTIONAL ART)
FIG. 9 is a side view of a conventional lift apparatus.

FIG. 1 includes a sketch of a free-body diagram of a pivot point 44 which connects one end of the moving device 24 to the arm structure 22. With this free-body diagram, the mechanical advantage of the present invention can be appreciated. The displacing means 28 provides an increased angle θ between longitudinal axis M of the moving device 24 and the longitudinal axis A22 of arm structure 22, during at least a portion of the range of motion of arm structure 22 as compared to the conventional art of FIG. 9. This increased angle θ is attributed to several parameters: distances D1, D2, and D3 discussed in detail below with respect to FIG. 2; and the displacing means providing rotational movement as well as translational movement of the moving device 24 during a portion of the range of motion of the arm structure 22. With this increased angle θ, Force component $F_{24a}$ is substantially increased so that Force $F_{24}$ more effectively counteracts or more directly opposes Force $F_{22}$.

The angle θ in the conventional art (between the longitudinal axis B1 of the moving device 16 and the longitudinal axis A1 of arm structure 12) substantially approaches 0° as arm structure 12 approaches a fully extended position. In the present invention, the angle θ (between the longitudinal axis M of the moving device 24 and longitudinal axis A22 of the arm structure 22) is increased by displacement of moving device 24 so that more of the Force $F_{24}$, specifically Force component $F_{24a}$, will counteract/interact/offset the magnitude and direction of the force $F_{22}$ of the arm structure 22. This is possible because of the triangular arrangement of the first and second pivot points 34 and 36, and intersection point 42 on the arm structure 30. It is noted that reactionary force $F_{22}$ of the arm structure 22 is generated by a component of the force due to weight of arm structure 22 (mass (m)×gravity (g)) and any load on arm structure 22.

It is noted that the mechanical advantage of the present invention in the disclosed embodiment is achieved between two operating positions, an intermediate position wherein the moving device is first displaced and a fully extended position wherein arm structures 22 and 30 are in a substantially fully extended position, as explained more fully below.

As illustrated in FIG. 2, D1 is the shortest linear distance between first pivot point 34 and longitudinal center axis A30 of arm structure 30. Another important design parameter includes a distance D2, the shortest linear distance between a center axis of the second pivot point 36 and the longitudinal center axis A30 of arm structure 30. Further, another important parameter is distance D3 which is the shortest linear distance between lines D1 and D2. Adjustments to these distances will significantly affect the mechanical advantage provided by the present invention. To provide the mechanical advantage of the present invention, distance D1 is typically substantially greater than distance D2. Increasing D3 generally increases the mechanical advantage obtainable by the invention.

In the illustrated embodiment, the connecting plate 26 is shaped similarly to the relative locations of the pivot points 34 and 36. Accordingly, the connecting plate includes a triangular attachment portion 38 and a polygonal-shaped attachment portion 40. FIG. 1 also shows a phantom line 39 which divides the connecting plate 26 into the first attachment portion 40 and the second attachment portion 38 which includes the first and second pivot points 34 and 36. Phantom line 39 is substantially parallel to a longitudinal center axis A30 of arm structure 30. Also shown in FIG. 1 is the pin/cylinder arrangement 37 which fastens the moving device 24 to the displacing means 28.

The connecting plate 26 which includes attachment portions 38 and 40 that can have multiple shapes, has an important feature of the present invention in that the first pivot point 34 and the second pivot point 36 are arranged so as to increase an angle θ formed between a longitudinal axis M of moving device 24 and the longitudinal axis A22 of arm structure 22 upon movement of displacing means 28. In the disclosed embodiment, points 34, 36 and 42 form a triangular configuration.

Figure 3:
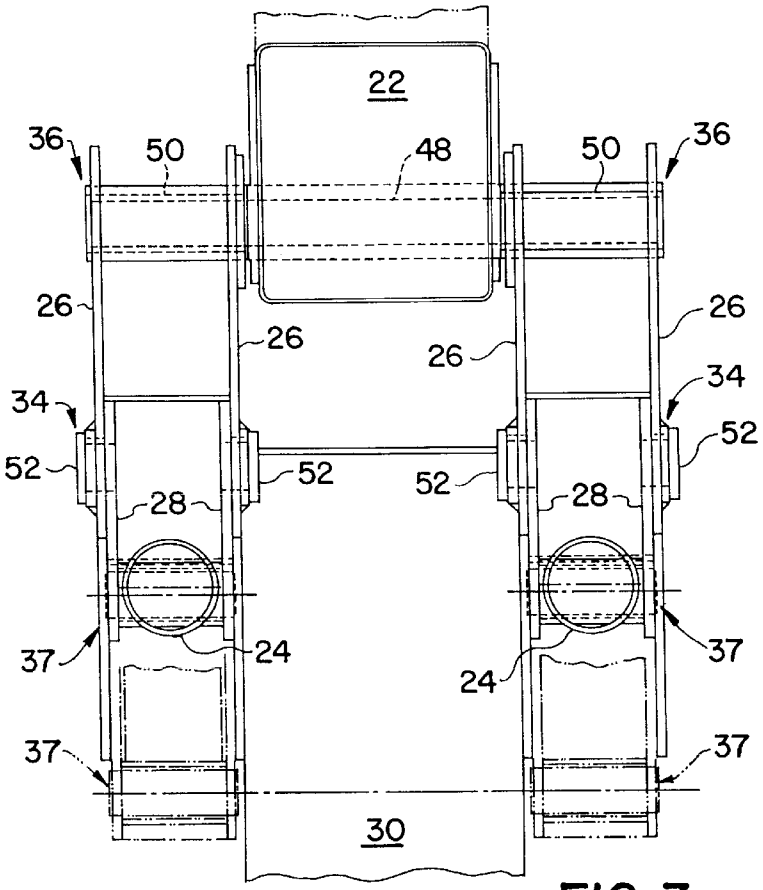
FIG. 3 is an end view of the lift apparatus of the present invention.

In FIG. 3, an end or rear view of the present invention is shown where a plurality of connecting plates 26 and means for displacing 28 are employed. As stated above, arm structure 22 and displacing means 28 are attached to the pivot points 34 and 36 by pin/cylinder arrangements. Specifically, arm structure 22 rotates about a pin or shaft 48 that is inserted into cylinders 50 of the pivot points 36. The cylinders 50 are disposed within apertures of each pivot point 36 which have a size that substantially corresponds with the cylinders 50. The displacing means 28 is connected to each connecting plate 26 via pins 52 which pass through apertures in the connecting plates 26 and displacing means 28.

Figure 4:
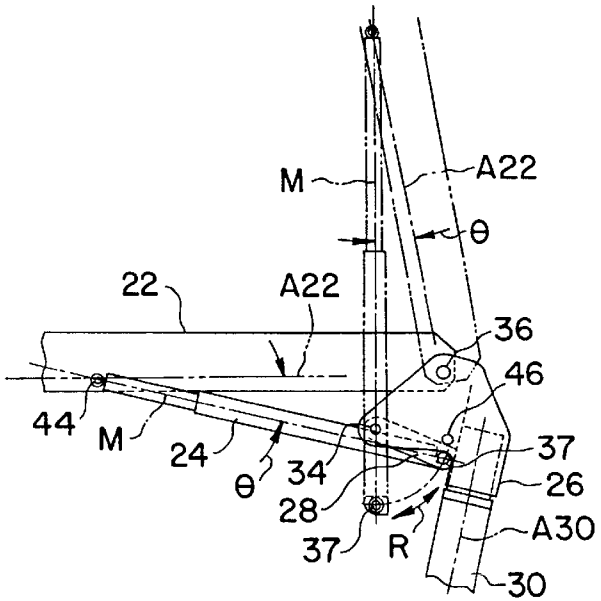
FIG. 4 is a side view of the lift apparatus of the present invention in an intermediate position.

FIG. 4 shows arm structure 22 in a first position shown in solid lines that is almost perpendicular to arm structure 30 and a second position wherein arm structure 22 is nearly parallel or at an angle 180° with respect to arm structure 30. FIG. 4 illustrates one end of the range of motion in which the mechanical advantage of the present invention can be observed.

When the apparatus is in a stowed position, moving device 24 and displacing means 28 abut against stopping device 46. As device 24 is actuated to move arm structure 22, displacing means 28 remains in this position for an initial range of motion of arm structure 22. At a point where device 24 becomes substantially parallel to displacement device 28, device 24 comes into contact with plate portion 28' (FIG. 2). Thereafter, as rotation of arm 22 continues, means 28 starts to rotate about point 34 as shown by arc R so that angle θ between the longitudinal axis M of moving device 24 and the longitudinal axis A22 of arm structure 22 is increased. Movement of displacement means 28 will commence at a point of rotation of arm 22 just beyond the solid line position shown in FIG. 4.

As arm structure 22 is moved towards a position where arm structure 22 is substantially 180° with respect to arm structure 30, the displacing means 28 continues to rotate about point 34 about an arc R so that angle θ between axis M and axis A22 remains substantially constant or decreases at a substantially reduced rate as compared to the motion of the conventional art. The important feature is that angle θ is maintained greater than it would be in similar conventional devices, and mechanical advantage and range of motion are increased.

FIG. 4 shows an intermediate position of arm structure 22 and arm structure 30 between the fully extended or fully erected position and the stowed position. Such intermediate positions of arm structure 30 may be utilized to reduce the overall height of the arm structure 30 and arm structure 22 during operation for loading applications which require reduced height.

Figure 5:
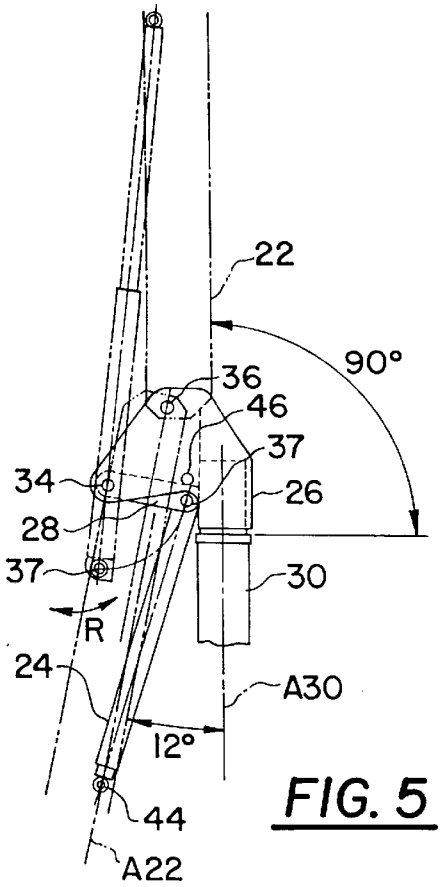
FIG. 5 is a side view of the lifting apparatus of the present invention in a fully extended or erected position as well as in a lifting operational state.

In the uppermost portion of FIG. 5, as shown by dotted lines, the arm structure 22 is substantially parallel with arm structure 30 in a fully extended or erected position. With the present invention, arm structure 22 has a range of motion relative to arm structure 30 of up to at least 180° as measured between the axis of arm structure 22 and the longitudinal axis A30 of arm structure 30. In a stowed position, arm structures 22 and 30 are adjacent to each other and parallel or nearly parallel (FIG. 6), forming an angle between these axes of zero or about −20° in the illustrated embodiment. However, the present invention is not limited to this range of motion of arm structure 22, and can include a range of motion which falls outside or within this range depending upon the relative location of pivot points 34 and 36 relative to arm structure 30.

FIG. 5 also shows in solid lines the displacing means 28 in a position where the displacing means 28 contacts stopping device 46. Displacing means 28 contacts stopping device 46 when arm structure 22 is at an angle with arm structure 30 as shown in solid lines in FIG. 4, or at smaller angles between longitudinal axis A22 and longitudinal axis A30. As noted above, the mechanical advantage of the present invention is achieved when displacing means 28 displaces or translates moving device 24 in the movement direction R.

Figure 6:
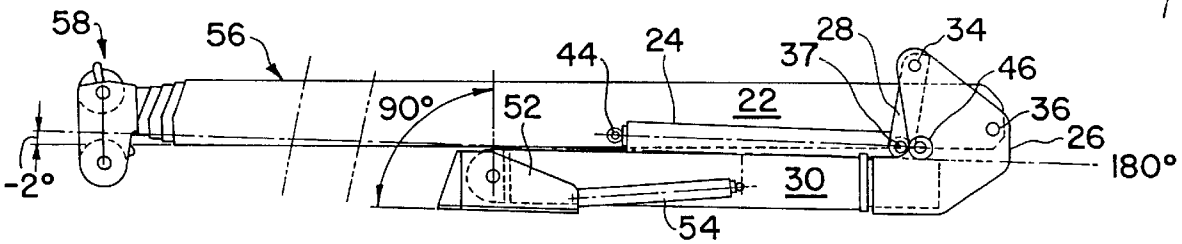
FIG. 6 is a side view of the lifting apparatus of the present invention in a stowed position.

In FIG. 6, the arm structures 22 and 30 are in a stowed position. FIG. 6 also shows a base plate 52 and a moving device 54 which is attached to the base plate 52 and the arm structure 30. Also shown in FIG. 6, in a stowed position, arm structure 22 of the illustrated embodiment is at −20° relative to arm structure 30. However, the present invention is not limited to this relative position of arm structure 22 relative to arm structure 30. The angle of the stowed position of the armed structure 22 is dependent upon the relative location of the second pivot point 36 relative to arm structure 30. As the distance between the pivot point 36 and arm structure 30 is increased, the negative measure of the angle of the final stowed position of the arm structure 22 relative to the arm structure 30 will also increase, and vise versa.

Figure 7:
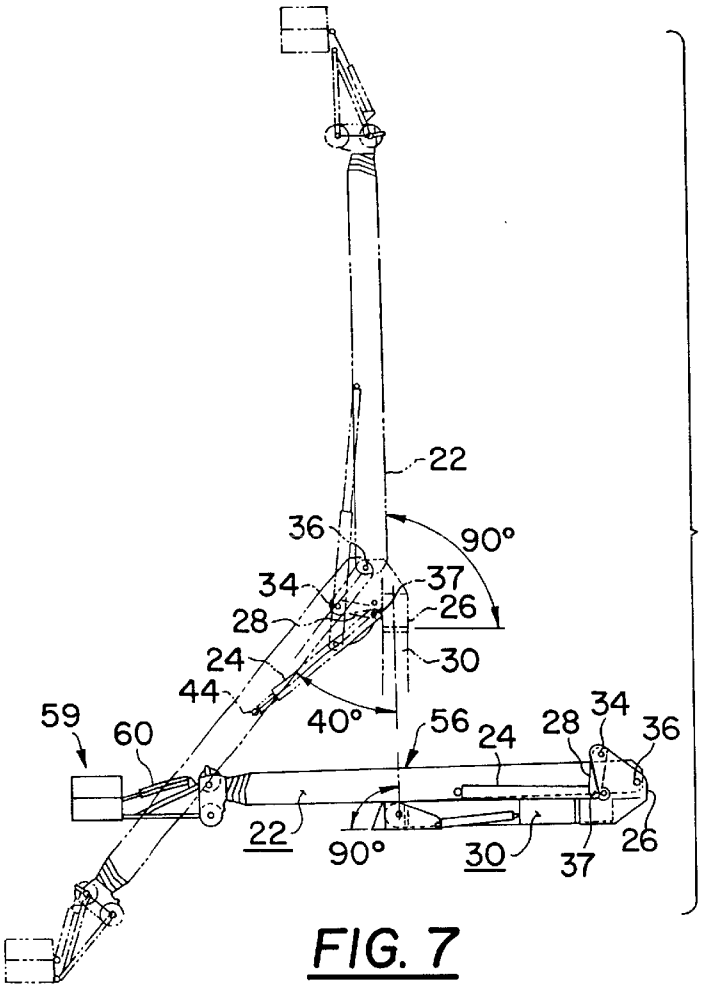
FIG. 7 is a side view of the lift apparatus in an embodiment which employs an aerial work platform.

FIG. 7 shows another embodiment of the present invention. In this embodiment, attached to one end of the telescoping boom arrangement 56 is an aerial work platform 59.

The aerial work platform 59 is connected to the telescoping boom arrangement 56 by a plurality of moving devices 60 which are typically hydraulic piston and cylinder arrangements. A typical range of motion of arm structure 22 with respect to arm structure 30 is generally between 40° to 180° as shown by dashed lines. However, the invention is not limited to this preferred range and can include a range of motion which falls outside or within this range depending upon the relative location of pivot points 34 and 36 relative to arm structure 30.

The moving devices 60 are designed to keep the aerial work platform 59 in a position parallel to a horizontal axis irrespective of the position of arm structure 22 relative to the horizontal axis. Accordingly, an aerial work platform user is kept level at all times during relative vertical movement of the aerial work platform 59.

Figure 8:
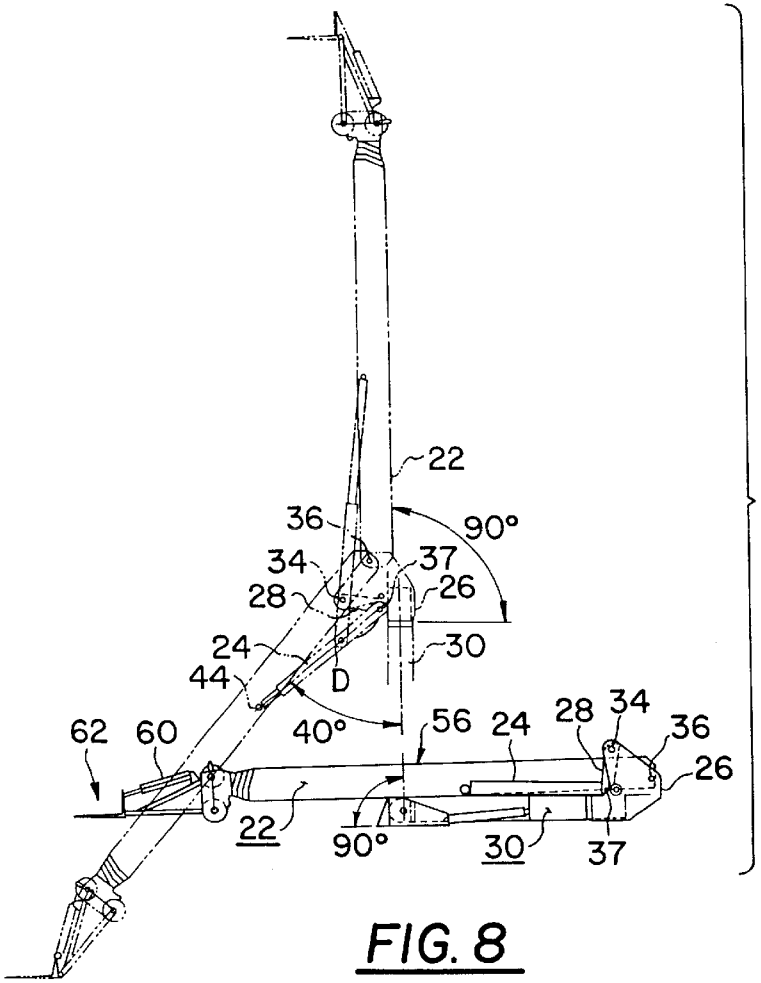
FIG. 8 a side view of the lift apparatus in an embodiment which employs a lifting platform.

In FIG. 8, another embodiment of the present invention is shown. A lifting platform 62 is attached to the telescoping boom arrangement 56. The lifting platform 62 is designed to lift objects. While well suited for these purposes, the present invention is not limited to use in cranes, lifting platforms, or aerial work platforms.

The present invention provides an improved lift method for moving an arm structure in an apparatus which includes a first arm structure and a second arm structure and a moving device. The moving device is attached to at least one of the arms by a displacing device. When the second arm structure is moved relative to the first arm structure with the moving device, during at least a portion of the range of such motion, the moving device is simultaneously displaced relative to one of the arms. This results in improved mechanical advantage and increased range of relative motion.

In further specific aspects, the method of the present invention may further include steps of spacing one end of the displacing device 28 at a distance from a longitudinal axis A30 of the first arm structure 30; limiting counter-clockwise movement of device 28 during a predetermined range of motion of the second arm structure 22; or placing the first and said second pivot points 34 and 36 relative to a point 42 on the first arm structure 30 to form a substantially triangular configuration.

The preferred materials in typical applications for arm structure 22 and arm structure 30 are 100 KSI yield steel. The connecting plate 26 is also preferably made of steel. Other materials are not beyond the scope of the present invention. Other materials include, but are not limited to, other ferrous alloys, non-ferrous alloys, ceramic materials, polymers, and composite materials. The type of materials for the arm structure 22 and arm structure 30 in addition to the connecting plate 26 will typically be a function of the intended environment.

The present invention may be employed in self-propelled hydraulic cranes and hydraulic cranes with truck-type bases, but is not limited to these type of cranes. Other cranes of the present invention include, but are not limited to, rough-terrain cranes, all-terrain cranes, industrial cranes, city cranes, locomotive cranes, truck cranes which include tower cranes and conventional cranes, and other boom type lifting and people moving devices. The invention is also not limited to the field of cranes. Other fields of the present invention include, but are not limited to, hoisting machines, robotics, actuators for bridges and other like civil engineering structures, towing devices, shipyard devices, aerial platforms, lift platforms, heavy-duty construction or earth-moving equipment such as back-hoes and/or bull dozers, and other like environments where vertical motive forces, including lifting forces are required.

While the moving device 24 is shown as a hydraulic piston and cylinder arrangement, the moving device is not limited to this type of powered actuation. Other moving devices 24 include, but are not limited to, pneumatic piston and cylinder arrangements, gear and motor combinations, lead screw/motor arrangements, and other like devices. The displacing means 28 is not limited to a single link and may include other structures which facilitate displacement of the moving device 24 to achieve the desired results. Other displacement devices include, but are not limited to, a series of links also known as linkages, pin cylinder arrangements coupled with a holder to support the moving device 24, clips and/or fasteners, hinges, and other like displacing devices.

Other types of fastening devices for connecting the moving device 24 to the displacing means 28 are not beyond the scope of the present invention. Other types of fastening devices include, but are not limited to, hinges, hooks, rotating latches, bolts, rivets, bearings and other like structures which the permit the desired movement of the displacement means 28.

The second pivot point 36 is also not limited to the fastening devices shown and may include all the fastening devices enumerated above for the first pivot point 34 or other suitable structures. Other types of stopping devices 46 are also not beyond the scope of the present invention. Other stopping devices include, but are not limited to, a welded plate assembly, solid rectangular blocks, elastic or rubber mounts, and other like devices which stop movement. The shape of the attachment portion 38 is not limited to triangular shapes.

Furthermore, the number of moving devices 24 and displacing means 28 are not limited to those shown in the Figures. Additional or fewer connecting plates 26 with respective moving devices 24 are not beyond the scope of the present invention for loading applications which require differing amounts of lift. The present invention can also employ single connecting plates 26 as well as only one moving device 24 for smaller load applications.

The working devices 60 which connect the aerial work platform 59 or lifting platform 62 to the telescoping boom arrangement 56 are not themselves part of the present invention. Rather these are shown as part of an apparatus which utilizes the lifting arrangement of the invention.

The present invention provides a lift method and apparatus for moving an arm structure which substantially increases a range of motion of a second arm structure relative to a first arm structure while providing a mechanical advantage for the moving device whereby work required to move the second arm structure relative to the first arm structure is substantially reduced while lifting capacity of the moving device is substantially increased. Also, the lift method and apparatus of the present invention substantially lowers an overall height and a center of gravity of a combined first arm structure 22, a second arm structure 30, and a connecting plate 26 system when the first arm structure 30 and second arm structure 22 are in a stowed position.

The present invention provides a lift method and apparatus that allows for increased Lifting capacity, weight savings, manufacturing cost savings, and a reduction in work performed by the moving device 24 or a reduction in hydraulic pressure. The present invention makes substantially more compact the mechanical elements which connect the moving device 24 to the arm structure, while substantially achieving a shorter load radius for a given boom length or second arm structure length.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A method of operating an lifting apparatus including a first arm structure having a longitudinal axis; a connecting plate including a first attachment portion connected to the first arm structure; a second arm structure rotatably attached to the connecting plate at a first pivot point; a displacing link rotatably attached to the connecting plate at a second pivot point, wherein the first and second pivot points are in a second attachment portion of the connecting plate and wherein the first and second pivot points and a predetermined point on the longitudinal axis of the first arm structure are in a substantially triangular configuration; and a moving device connected between the displacing link and the second arm structure; said method comprising the steps of:

activating the moving device to cause a range of motion of the second arm structure relative to the first arm structure;

moving the displacing link;

displacing the moving device relative to the first arm structure in response to and during only a portion of the range of motion of the second arm structure relative to the first arm structure;

increasing the range of motion of the second arm structure relative to the first arm structure; and increasing a mechanical advantage for moving the second arm structure relative to the first arm structure.

2. The method according to claim 1, wherein said activating step results in a range of movement of said second arm structure relative to said first arm structure which includes said second arm structure forming at least a 180 degree angle relative to said first arm structure.

3. The method according to claim 1, wherein said activating step results in a range of movement of said second arm structure relative to said first arm structure which includes said second arm structure forming angles of between −2 degrees and 180 degrees relative to said first arm structure.

4. The method according to claim 1, wherein said second arm structure includes a telescoping boom arrangement and further comprising the step of:

extending the telescoping boom arrangement.

5. The method according to claim 1, further comprising the steps of:

providing a stop;

contacting the displacing link with the stop; and stopping movement of the displacing link when said contacting step occurs.

6. A method of operating an lifting apparatus including a first arm structure having a longitudinal axis; a connecting plate including a first attachment portion connected to the first arm structure; a second arm structure rotatably attached to the connecting plate at a first pivot point; a displacing link rotatably attached to the connecting plate at a second pivot point, wherein the first and second pivot points are in a second attachment portion of the connecting plate and wherein the first and second pivot points and a predetermined point on the longitudinal axis of the first arm structure are in a substantially triangular configuration; and a moving device connected between the displacing link and the second arm structure; said method comprising the steps of:

activating the moving device to cause a range of motion of the second arm structure relative to the first arm structure;

moving the displacing link;

displacing the moving device relative to the first arm structure in response to and during at least a portion of the range of motion of the second arm structure relative to the first arm structure;

increasing the range of motion of the second arm structure relative to the first arm structure; and increasing a mechanical advantage for moving the second arm structure relative to the first arm structure.

7. The method according to claim 6, wherein said activating step results in a range of movement of said second arm structure relative to said first arm structure which includes said second arm structure forming at least a 180 degree angle relative to said first arm structure.

8. The method according to claim 6, wherein said activating step results in a range of movement of said second arm structure relative to said first arm structure which includes said second arm structure forming angles of between −2 degrees and 180 degrees relative to said first arm structure.

9. The method according to claim 6, wherein said second arm structure includes a telescoping boom arrangement and further comprising the step of:

extending the telescoping boom arrangement.

10. The method according to claim 6, further comprising the steps of:

providing a stop;

contacting the displacing link with the stop; and stopping movement of the displacing link when said contacting step occurs.

11. A method of operating an lifting apparatus including a first arm structure having a longitudinal axis; a connecting plate including a first attachment portion connected to the first arm structure; a second arm structure rotatably attached to the connecting plate at a first pivot point; a displacing link rotatably attached to the connecting plate at a second pivot point, wherein the first and second pivot points are in a second attachment portion of the connecting plate and wherein the first and second pivot points and a predetermined point on the longitudinal axis of the first arm structure are in a substantially triangular configuration; and a moving device connected between the displacing link and the second arm structure; said method comprising the steps of:

activating the moving device to cause a range of motion of the second arm structure relative to the first arm structure;

moving the displacing link;

displacing the moving device relative to the first arm structure in response to and during only a portion of the range of motion of the second arm structure relative to the first arm structure, such that a pivot point between the moving device and displacing link is a fixed pivot point during a first portion of the range of motion of the second arm structure and the pivot point moves during a second portion of the range of motion of the second arm structure;

increasing the range of motion of the second arm structure relative to the first arm structure; and increasing a mechanical advantage for moving the second arm structure relative to the first arm structure.

12. The method according to claim 11, wherein said activating step results in a range of movement of said second arm structure relative to said first arm structure which includes said second arm structure forming at least a 180 degree angle relative to said first arm structure.

13. The method according to claim 11, wherein said activating step results in a range of movement of said second arm structure relative to said first arm structure which includes said second arm structure forming angles of between −2 degrees and 180 degrees relative to said first arm structure.

14. The method according to claim 11, wherein said second arm structure includes a telescoping boom arrangement and further comprising the step of:

extending the telescoping boom arrangement.

15. The method according to claim 11, further comprising the steps of:

providing a stop;

contacting the displacing link with the stop; and stopping movement of the displacing link when said contacting step occurs.

16. A method of operating an lifting apparatus including a first arm structure having a longitudinal axis; a connecting plate including a first attachment portion connected to the first arm structure; a second arm structure rotatably attached to the connecting plate at a first pivot point; a displacing link rotatably attached to the connecting plate at a second pivot point, wherein the first and second pivot points are in a second attachment portion of the connecting plate and wherein the first and second pivot points and a predetermined point on the longitudinal axis of the first arm structure are in a substantially triangular configuration; and a moving device connected between the displacing link and the second arm structure; said method comprising the steps of:

activating the moving device to cause a range of motion of the second arm structure relative to the first arm structure;

moving the displacing link, in response to movement of a mass of the second arm structure;

displacing the moving device relative to the first arm structure in response to and during at least a portion of the range of motion of the second arm structure relative to the first arm structure;

increasing the range of motion of the second arm structure relative to the first arm structure; and increasing a mechanical advantage for moving the second arm structure relative to the first arm structure.

17. The method according to claim 16, wherein said activating step results in a range of movement of said second arm structure relative to said first arm structure which includes said second arm structure forming at least a 180 degree angle relative to said first arm structure.

18. The method according to claim 16, wherein said activating step results in a range of movement of said second arm structure relative to said first arm structure which includes said second arm structure forming angles of between −2 degrees and 180 degrees relative to said first arm structure.

19. The method according to claim 16, wherein said second arm structure includes a telescoping boom arrangement and further comprising the step of:

extending the telescoping boom arrangement.

20. The method according to claim 16, further comprising the steps of:

providing a stop;

contacting the displacing link with the stop; and stopping movement of the displacing link when said contacting step occurs.

* * * * *